United States Patent [19]

Wrench

[11] Patent Number: 4,872,378

[45] Date of Patent: Oct. 10, 1989

[54] HOLDER FOR KNIFE SHARPENER OR THE LIKE

[76] Inventor: Robert A. Wrench, 8542 72nd Ave., N.W., Seattle, Wash. 98117

[21] Appl. No.: 173,561

[22] Filed: Mar. 22, 1988

[51] Int. Cl.[4] ..... A01D 3/00; B24B 3/36

[52] U.S. Cl. ..... 76/86; 248/310

[58] Field of Search ..... 76/86, 82, 82.2, 88; 248/310, 309.1

[56] References Cited

U.S. PATENT DOCUMENTS

| | | | |
|---|---|---|---|
| 66,837 | 7/1867 | Herthal | 76/86 |
| 70,360 | 10/1867 | Reynolds | 76/86 |
| 892,667 | 7/1908 | Jauch | 76/86 |
| 1,032,910 | 7/1912 | Jackson | 76/86 |
| 1,429,984 | 9/1922 | Vollmer | 76/86 |
| 1,457,073 | 5/1923 | Hornke | 76/86 |
| 3,107,889 | 10/1963 | Peterson | 248/310 |
| 4,550,632 | 11/1985 | Inman | 76/86 |

FOREIGN PATENT DOCUMENTS

| | | | |
|---|---|---|---|
| 1083002 | 6/1954 | France | 76/86 |
| 901718 | 2/1982 | U.S.S.R. | 248/310 |

*Primary Examiner*—Roscoe V. Parker

*Attorney, Agent, or Firm*—Robert W. Jenny

[57] ABSTRACT

The holder comprises a body slotted to fit over a side of a partially opened cabinet drawer and shaped to fit against the inside surface of the front of the drawer. In a preferred embodiment the upper end of the body is fitted with a "crossed steels" knife sharpener and a slanted steel scissors sharpener situated in slots in the upper end. The holder is removed and stored in the drawer when not needed.

2 Claims, 1 Drawing Sheet

HOLDER FOR KNIFE SHARPENER OR THE LIKE

BACKGROUND OF THE INVENTION

1. FIELD:

The holder is in the field of apparatus for holding tools, apparatus such as clamps, brackets, handles, bases and the like. More specifically it is in the field of such apparatus which will satisfactorily support a tool, such as a knife sharpener, without need for adjustable elements such as screws or levers. Still more specifically, it is in the field of apparatus for holding knife sharpeners.

2. PRIOR ART:

Various holders specfically for knife sharpeners, are shown in U.S. Pat. Nos.:

| | | |
|---|---|---|
| 66,837 | 1,032,910 | 1,457,073 |
| 70,360 | 1,429,984 | 4,550,632 |

All these patents show apparatus for holding elements arranged to form a V shaped notch through which the knife edge is drawn to sharpen the edge. All but the sharpener of 4,550,632 involve means for fastening the apparatus in place, such as clamps and fasteners. The apparatus of 4,550,632 comprises a handle for holding it in place while a knife is being sharpened. Sharpeners comprising overlapping metal discs to provide a sharpening notch are commercially available, the discs being mounted in a bracket on the end of a handle. With these prior art devices and any others used with a handle there is the danger of the knife slipping from the sharpening notch and injuring the user. Also, considerable finger strength and manual dexterity are required to effectively use such devices. Therefore it is an objective of the subject invention to provide a holder for a knife sharpener or the like which can be used effectively with minimum finger strength and manual dexterity and with which danger of injury is clearly minimal. Further objectives are that the holder be readily storable, durable and inexpensive compared to known prior art.

SUMMARY OF THE INVENTION

The subject holder is essentially a flat block of material having two relatively large flat faces, two sides and two ends. The block is slotted from side to side to a depth of about two-thirds the distance from one end to the other. The closed end is radiused from face to face and fitted with the sharpening apparatus. The holder is used with an opened drawer such as a kitchen cabinet drawer. The slot is fitted over the top of a side of the drawer with one side against the inside of the front panel of the drawer. This positioning puts the sharpening apparatus in position for use by drawing the edge of a knife through it, the user using one hand to handle the knife while holding the drawer knob with the other, if desired. A preferred sharpening apparatus for use with this holder is the crossed rod type, the rods being known as steels. The steels are set into the top, unslotted end in grooves in which the intersection of the steels is exposed. More than one sharpening apparatus may be installed depending in part on the width selected for the holder. Other devices such as bottle cap removers can also be attached to or built into the holder. Sharpeners can be adapted to sharpen scissors.

It is convenient that the thickness of the sides of cabinet drawers is generally standardized and the widh of the slot in the holder is adapted to this standard thickness.

The invention is described in more detail below with reference to the attached drawings.

DETAILED DESCRIPTION OF THE INVENTION

Figure 1:
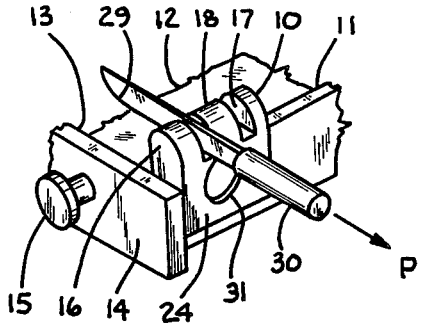
FIG.1 is a perspective view of the holder adapted as a knife sharpener and installed on the side of a cabinet drawer.
Figure 2:
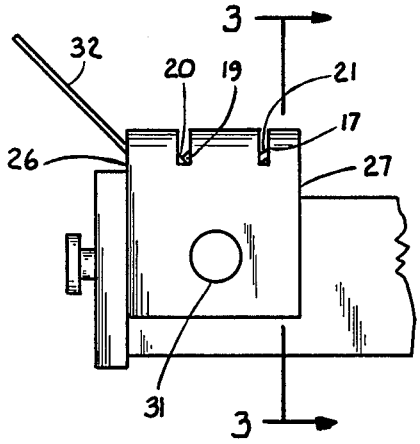
FIG. 2 is a side view of the holder and sharpening apparatus installed on the side of a cabinet drawer.
Figure 4:
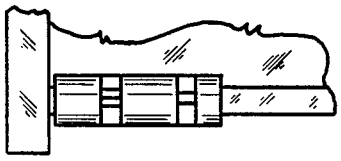
FIG. 4 is a top view of the holder with knife sharpening apparatus installed.

FIG. 1 illustrates holder 10 in place on side 11 of drawer 12, up against back side 13 of drawer front 14 fitted with knob 15. Slots 16 and 17 are set into top end 18 of the holder. Slot 16 is fitted with knife sharpening apparatus and slot 17 with scissors sharpening apparatus. In FIGS. 2 and 4, with parts numbers as in FIG. 1, the sharpening apparatus is shown. The knife sharpening apparatus comprises two steels 19 and 20 positioned next to each other in crossed relationship, such sharpening apparatus being well known in the art. The scissors sharpening apparatus comprises steel 21 installed in slot 17, such apparatus also being well known in the art.

Figure 3:
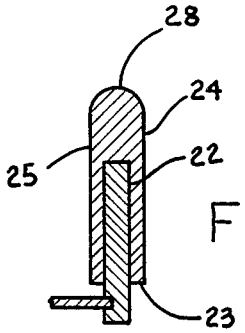
FIG. 3 is a sectional view of the holder taken at 3—3 in FIG. 2.

FIG. 3, a sectional view of the holder taken at 3—3 in FIG. 2, shows slot 22 set into bottom 23 of the holder, midway between faces 24 and 25, running from side 26 to side 27 (FIG. 2) of the holder and extending about $\frac{2}{3}$ the distance from bottom 23 to top 28. Top 28 is radiused primarilyf or aesthetic purposes.

The holder is shown in position for use in the illustrations. Sharpening is done by pulling the item to be sharpened across the steel, such as sharpening edge 29 of knife 30 in FIG. 1 by pulling it in the direction indicated by arrow P. Hole 31 may be added in face 24 and a similar one in face 25 to provide a grip for removal of the holder, a grip not requiring the finger length needed to reach bottom 23.

The holder may incorporate a guard 32 (FIG. 2), permanently installed or removalbl, to further guard against accidental movement of an item being sharpened toward the drawer knob which may be held by a user's hand (FIG. 4).

It can be understood from these descriptions that the invention meets its objectives. The holder can be used effectively with only sufficient finger strength to slip it into the drawer side. Manual dexterity required is clearly minimal as is danger in its use to hold knife sharpening apparatus since the user's hand not being used to move the item being sharpened need not be at all close to the holder. Further, the holder can be readily stored in the drawer, ready for use. Its expense will be moderate due to its structural simplicity and compact configuration and its durability high, given proper material selection.

It will also be understood by those skilled in that art that while a preferred embodiment of the invention is described herein, other embodiments and modifications of the one described are possible within the scope of the invention which is limited only by the appended claims.

What is claimed is:

1. Apparatus holder for use on a drawer having a side and a front, said front having an inside surface, said holder comprising a body having a top, bottom and afirst side, said bottom of said body being slotted to fit over said side of said drawer with said first side of said body against said inside surface, whereby said top is accessible and include means for holding sharpening apparatus.

2. Apparatus holder for use on a drawer having a side and a front, said front having an inside surface, said holder comprising a body of essentially rectangular shape having:

a first face, a second face parallel to said first face, a first side of said body perpendicular to said first and second faces, a second side of said body parallel to said first side, a first end, perpendicular to said first and second faces and said first and second sides, said first end including means for supporting sharpening apparatus, a second end having a slot with an axis parallel to said first and second faces and said first end and perpendicular to said first and second sides and extending first distance from said first side to said second side between said first and second faces, said slot extending from said second end for a distance equal to between one-half and three-fourths of the distance between said first and second ends, whereby when said holder is positioned with said side in said slot and one of said first and second sides of said body against said inner surfce, said first end is accessible for supporting said sharpening apparatus.

* * * * *